US007293869B2

(12) United States Patent
Sanada et al.

(10) Patent No.: US 7,293,869 B2
(45) Date of Patent: Nov. 13, 2007

(54) RECORDING MEDIUM PROCESSING APPARATUS

(75) Inventors: Tsuyoshi Sanada, Liho Liho Rise (SG); Toshiharu Sekino, Izu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 420 days.

(21) Appl. No.: 11/078,056

(22) Filed: Mar. 11, 2005

(65) Prior Publication Data

US 2006/0203067 A1 Sep. 14, 2006

(51) Int. Cl.
*B41J 2/01* (2006.01)
*B41J 23/00* (2006.01)

(52) U.S. Cl. ..... 347/104; 347/37

(58) Field of Classification Search ..... 347/104, 347/37, 101, 8; 346/134; 399/361; 400/578
See application file for complete search history.

(56) References Cited

U.S. PATENT DOCUMENTS 5,000,594 A * 3/1991 Beehler et al. ..... 400/569
5,153,738 A * 10/1992 Stemmle ..... 358/296
5,806,992 A * 9/1998 Ju ..... 400/56
5,838,338 A * 11/1998 Olson ..... 347/8
5,841,450 A * 11/1998 Kawamura ..... 347/32
5,971,641 A * 10/1999 Looney ..... 400/628
5,993,094 A * 11/1999 Lee ..... 400/625
6,290,129 B2 9/2001 Momose
6,398,438 B1 * 6/2002 Kim et al. ..... 400/624
6,497,466 B1 * 12/2002 Writt ..... 347/8
6,550,907 B2 * 4/2003 Uchida ..... 347/104
2003/0030713 A1 * 2/2003 Izuma ..... 347/104

* cited by examiner

*Primary Examiner*—Stephen Meier
*Assistant Examiner*—Leonard Liang
(74) *Attorney, Agent, or Firm*—Frishauf, Holtz, Goodman & Chick, P.C.

(57) ABSTRACT

The apparatus has a carriage that holds a head, a carriage-driving mechanism having a motor, and a holding mechanism configured to press a recording medium to a medium-holding base. The holding mechanism has a pair of arm members and a pushing member secured to the arm members. A spring urges the holding mechanism toward the medium-holding base. The carriage can move to a first region and farther to as second region. In the first region, the head can read data from the recording medium. The apparatus has a sliding member that moves together with the carriage while the carriage remains in the second region. When the carriage moves to the second region and moves together with the carriage, the pushing member moves away from the medium-holding base.

7 Claims, 6 Drawing Sheets

RECORDING MEDIUM PROCESSING APPARATUS

BACKGROUND OF THE INVENTION

1. Field of the Invention

The present invention relates to a recording medium processing apparatus for recording data on paper sheets, such as documents and/or detecting magnetically the data recorded on the documents.

2. Description of the Related Art

An apparatus for recording data on documents or checks and/or detecting the data recorded on the documents has a carriage provided with a head. The carriage is moved reciprocally by a motor. A platen is located at the position opposite to the head. A recording medium such as a document is placed on the platen. The carriage is moved by the motor, and data is recorded on a medium by the head.

The printing apparatus disclosed in U.S. Pat. No. 6,290,129 B2, for example, has a carriage and a MICR head for reading MICR code (Magnetic Ink Character Readers code). A medium-holding roller is located at the position opposite to the MICR head with a recording medium interposed therebetween. The medium-holding roller is driven by a holding-mechanism from a position to come in contact the MICR head to a position to separate from the MICR head. The holding-mechanism uses a motor for moving the carriage as a driving source for driving the medium-holding roller. The recording medium is conveyed by the conveying-roller, and the MICR code is read by the MICR head.

In an apparatus for reading data by conveying a medium with respect to a fixed MICR head, a frictional force may be changed between the conveying-roller and medium or the medium may be caught in the medium conveying path when the medium is conveyed. These cause a change in the medium reading speed, and affect the reading accuracy.

It is considerable to contact and separate the head to/from the medium by using a holding-mechanism using another motor different from the one for moving the carriage. But, this configuration needs a motor and a power transmission system for the holding-mechanism in addition to the motor for moving the carriage.

BRIEF SUMMARY OF THE INVENTION

According to an aspect of the present invention, there is provided a recording medium processing apparatus comprising:

a carriage provided with a head; and a carriage-driving mechanism including a motor for reciprocating the carriage; and wherein the carriage can move to a first region for reading and/or recording information recorded in a recording medium, and to a second region farther than the first region;

the recording medium processing apparatus has a medium-holding base to hold the recording medium, and a holding mechanism to press the recording medium to the medium-holding base;

the holding mechanism comprising:

a fixing member located at a position corresponding to the medium-holding base;

an arm member which is held rotatably by the fixing member;

a pushing member which is secured to the arm member and moved from a position close to the medium-holding base to a position separated from the medium-holding base, as the arm member is rotated; and a sliding member which is driven by the carriage while the carriage remains in the second region, and moves the pushing member in a direction of separating from the medium-holding base when the carriage moves to the second region.

In a preferred embodiment of the present invention, the holding mechanism has a spring which urges the pushing member toward the medium-holding base, and a connector which transmits the motion of the sliding member to the pushing member.

In a preferred embodiment of the present invention, the holding mechanism has a pair of arm members held by the fixing member, and a parallel link is formed by the fixing member, arm members, and pushing member.

In a preferred embodiment of the present invention, a movable mechanism which can change the distance from the pushing member to the medium-holding base is further provided in a connecting portion which connects one of the arm members to the pushing member.

An elastic member having a rubber elasticity may be provided on the surface of the holding member opposite to the medium-holding base.

The sliding member may have a contact piece which comes in contact with the carriage when the carriage is moved to the second region.

A preferred embodiment of the present invention, further comprising:

a frame to secure the motor is provided; and a carriage shaft which is provided in the frame, and used to guide the carriage and sliding member to the first region and second region.

Additional objects and advantages of the invention will be set forth in the description which follows, and in part will be obvious from the description, or may be learned by practice of the invention.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
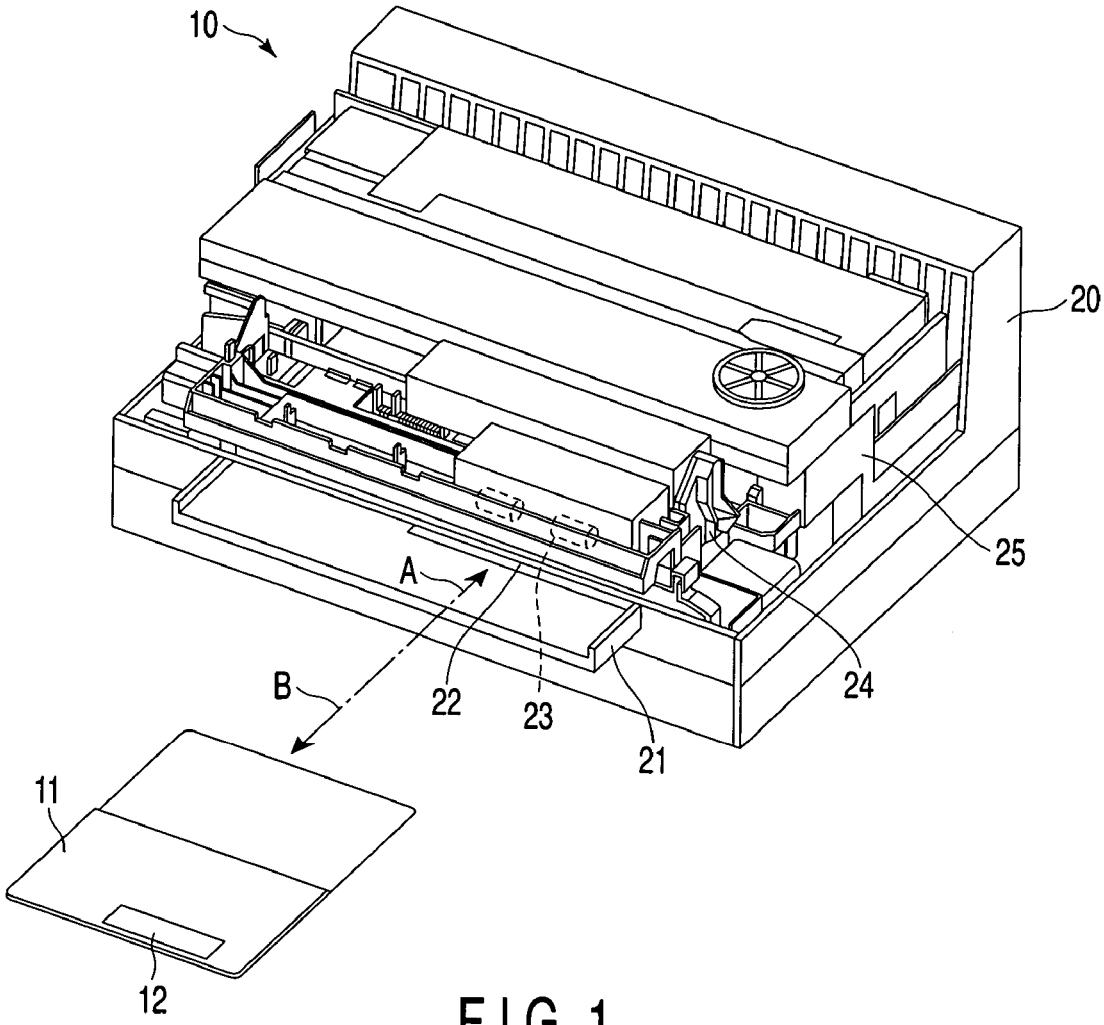
FIG. 1 is a perspective view of a recording medium processing apparatus according to an embodiment of the present invention.

A recording medium processing apparatus according to an embodiment of the present invention will be explained hereinafter with reference to FIG. 1 to FIG. 7. A recording medium processing apparatus 10 shown in FIG. 1 has a function of recording information on a recording medium 11 such as documents, and/or detecting the recorded information. A magnetic recording portion 12 is provided at a given position of the recording medium 11.

The recording medium processing apparatus 10 has a housing 20, a conveying guide 21, a medium insertion slit 22, a conveying mechanism 23 (partially shown) located in proximity to the medium insertion slit 22, a processing unit 24, and a printing block 25. The conveying guide 21 is used to guide the movement of the recording medium 11, when the recording medium 11 is inserted from the insertion slit 22 into the processing unit 24. The conveying mechanism 23 includes a feed roller for conveying the recording medium 11 in the direction indicated by the arrows A and B in FIG. 1. The printing block 25 has a function of printing at a given position of the recording medium 11.

Figure 2:
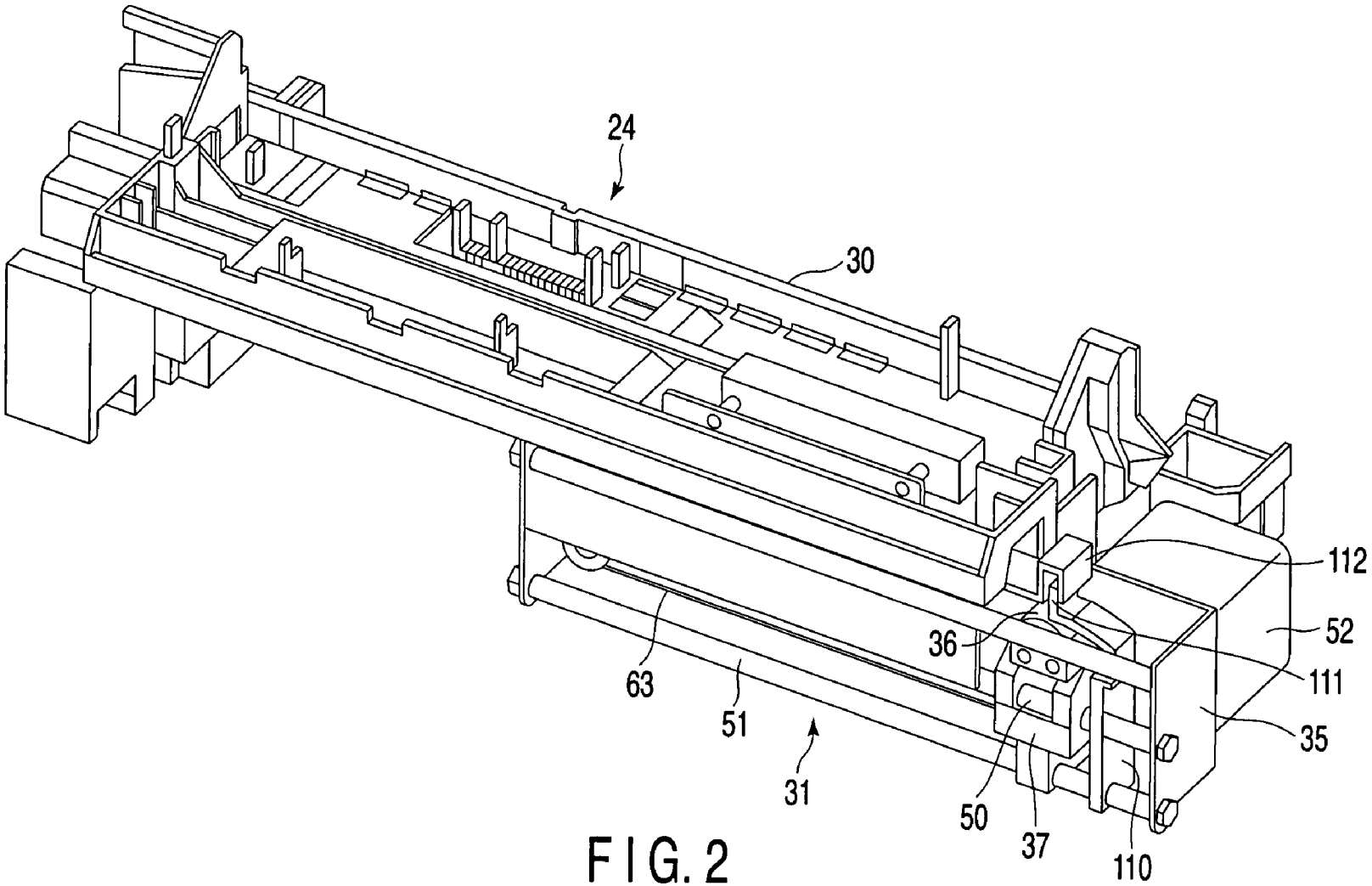
FIG. 2 is a perspective view of a processing unit of the recording medium processing apparatus shown in FIG. 1.
Figure 3:
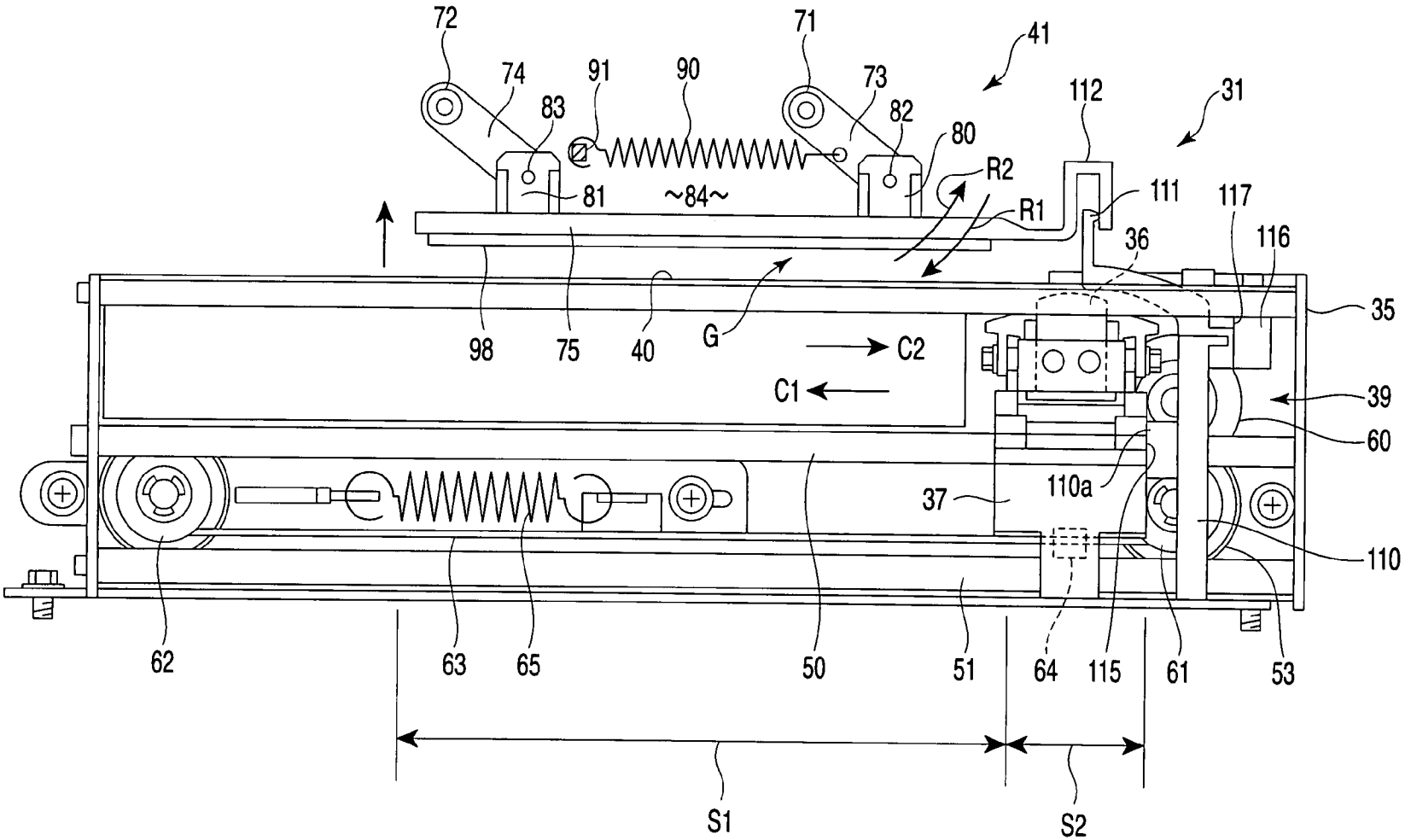
FIG. 3 is a front view of a processing mechanism of the processing unit shown in FIG. 2.
Figure 4:
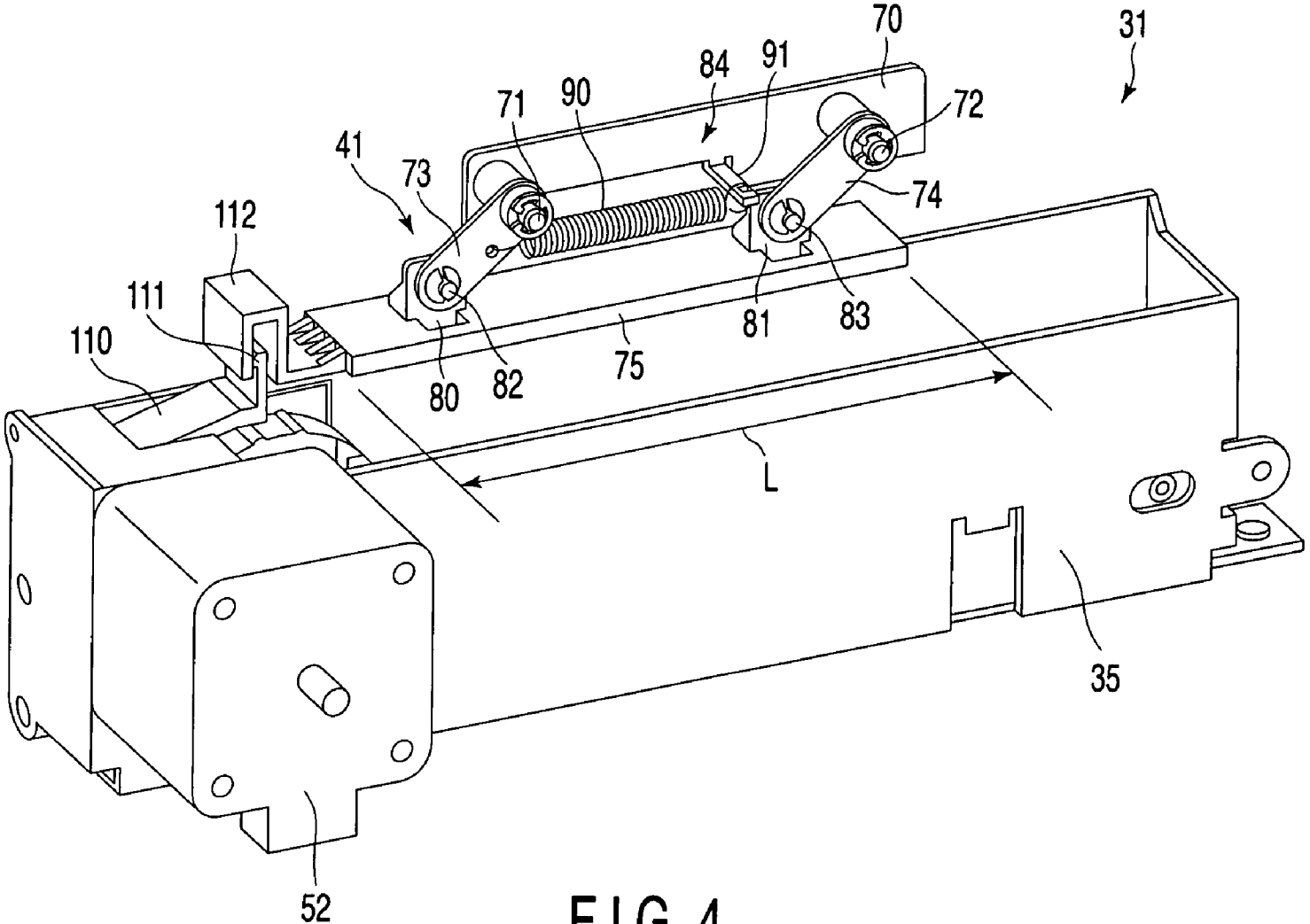
FIG. 4 is a perspective view of the processing mechanism shown in FIG. 3.

FIG. 2 shows the processing unit 24 incorporated in the recording medium processing apparatus 10. The processing unit 24 has a frame body structure 30 located inside the housing 20, and a processing mechanism 31 secured to the frame body structure 30. FIG. 3 and FIG. 4 show the processing mechanism 31.

The processing mechanism 31 shown in FIG. 3 has a frame 35, a carriage 37 provided with a head 36, a carriage-driving mechanism 39 for reciprocating the carriage, a medium-holding base 40 of the fixed side in which the recording medium 11 is mounted, and a holding mechanism 41 for pressing the recording medium 11 to the medium-holding base 40. The carriage 37 is reciprocated in a fist direction indicated by an arrow C1 and in a second direction indicated by an arrow C2.

The carriage-driving mechanism 39 has a carriage shaft 50 serving as a guide member for guiding the reciprocating movement of the carriage 37, a guide shaft 51 located parallel to the carriage shaft 50, a motor 52 (shown in FIG. 2 and FIG. 4) as a driving source of the carriage 37, and a power transmission system 53 which converts the rotational motion of the motor 52 into the reciprocating movement of the carriage 37.

The carriage 37 is moved along the carriage shaft 50 and guide shaft 51 in the directions indicated by the arrows C1 and C2. The carriage 37 is moved to a first region S1 and a second region S2. The first region S1 is a relatively long area that is moved over for the carriage for recording and/or detecting information in/from the recording medium 11. The second region S2 is an area farther than the first region S1, and shorter than the first region S1.

The power transmission system 53 includes a driving rotary member 60 which is rotated by the output shaft of the motor 52, a driving pulley 61 which is rotated and driven by the driving rotary member 60, a driven pulley 62 which is located at the position separated from the driving pulley 61, and a belt member (e.g., a timing belt) 63 laid over these pulleys 61 and 62. A base 64 of the carriage 37 is fixed to a part of the belt member 63. Thus, the carriage 37 is moved together with the belt member 63 in the directions of the arrows C1 and C2. The driving pulley 61 and driven pulley 62 are urged by a spring 65 in the direction to give tension to the belt member 63.

The motor 52 is rotated by an electric current. When the motor 52 is rotated in the first direction, the driving pulley 61 is rotated in the first direction (clockwise direction in FIG. 3). Thus, the belt member 63 is moved in the first direction, and the carriage 37 is moved in the first direction (indicated by the arrow C1). When the motor 52 is rotated in the second direction reverse to the first direction, the driving pulley 61 is rotated in the second direction (counter-clockwise direction in FIG. 3). Thus, the belt member 63 is moved in the second direction, and the carriage 37 is moved in the second direction (indicated by the arrow C2).

As example of the head 36 mounted on the carriage 37 has a detecting element and a recording element (not shown). The detecting element includes a coil for reading magnetically the data recorded in the magnetic recording portion 12 of the medium 11, for example. The recording element includes a coil for recording magnetically data in the recording medium 11, for example.

As shown in FIG. 4, the holding mechanism 41 has a fixing member 70 which is a fixing side member, a pair of holding shafts 71 and 72 provided in the fixing member 70, a pair of arm members (swing arms) 73 and 74 which are held rotatably by the holding shafts 71 and 72, and a pushing member 75 provided at the lower end of the arm members 73 and 74. The length L of the pushing member 75 is long enough to cover the first region S1 over which the carriage 37 is moved. The fixing member 70 is fixed to the frame body structure 30. The holding shafts 71 and 72 are separated each other in the length L direction.

The upper ends of the arm members 73 and 74 are held by the fixing member 70 through the holding shafts 71 and 72. The lower ends of the arm member 73 and 74 are rotatably connected to a pair of fixing parts 80 and 81 provided on the pushing member 75 through the shafts 82 and 83. The lengths of the arm members 73 and 74 are equal. The distance between the holding shafts 71 and 72 is equal to the distance between the shafts 82 and 83. Thus, a parallel link 84 is formed by the fixing member 70, arm members 73 and 74, and holding member 75.

Figure 5:
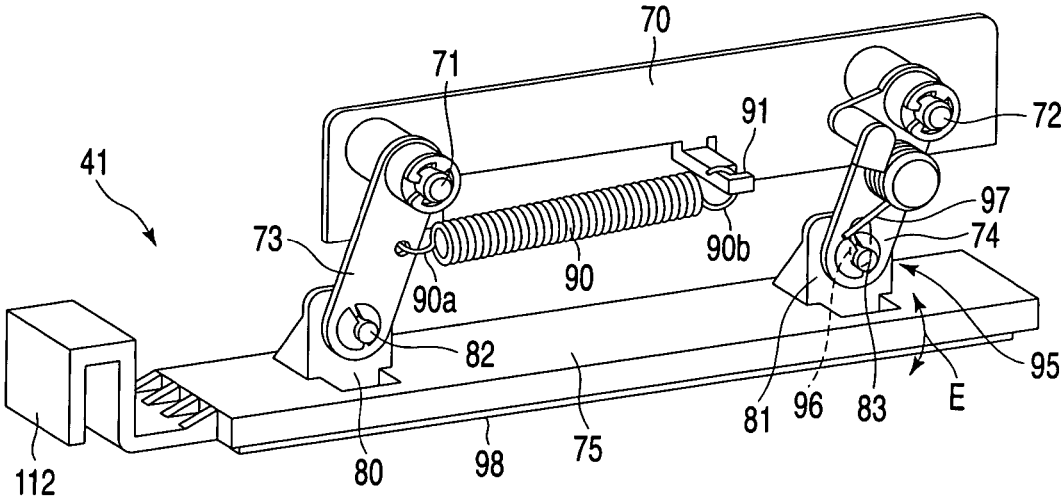
FIG. 5 is a perspective view of a holding-mechanism of the processing mechanism shown in FIG. 3.

The pushing member 75 is urged by a spring 90, such as a tensile coil spring toward the medium-holding base 40. Namely, as shown in FIG. 5, one end 90*a* of the spring 90 is hung on a spring hook 91 provided on the fixing member 70. The other end 90*b* of the spring 90 is hung on one arm member 73, energizing the arm member 73 in the direction indicated by an arrow R1 in FIG. 3.

As shown in FIG. 5, the lower end of one arm member 73 is connected to one fixing part 80 of the pushing member 75 through the shaft 82. The lower end of the other arm member 74 is connected to the other fixing part 81 of the pushing member 75 through a vertically movable mechanism 95. The movable mechanism 95 includes a vertical long hole 96 formed in the fixing part 81, a shaft 83 inserted in the vertical long hole 96, and a spring to urge the shaft 83 in the vertical direction.

The shaft 83 is movable vertically along the vertical long hole 96, and urged downward by a spring 97. Thus, in the pushing member 75, the other shaft 83 is movable vertically (in the direction indicated by an arrow E in FIG. 5) taking one shaft 82 as a fulcrum. Namely, the pushing member 75 can be inclined a little in the arrow E direction taking the shaft 82 as a fulcrum. This movable mechanism 95 permits the pushing member 75 to be inclined in the arrow E direction, when the thickness of the recording medium 11 is uneven.

Figure 6:
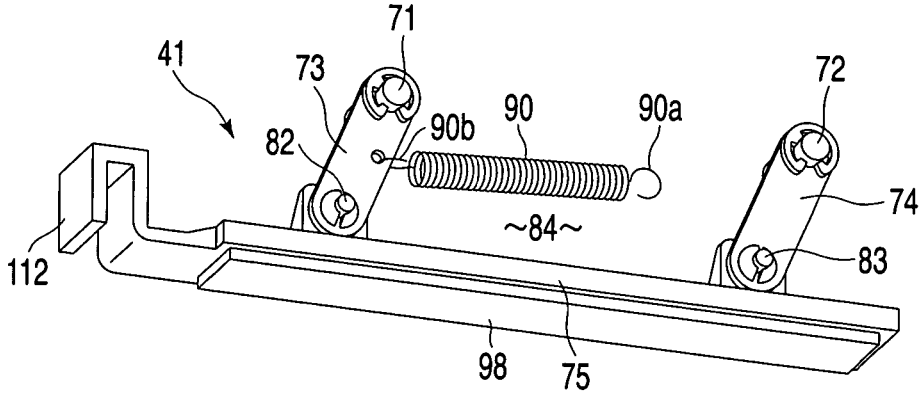
FIG. 6 is a perspective view of a part of the holding-mechanism shown in FIG. 5.

As shown in FIG. 6, an elastic member 98 having a rubber-like elasticity is provided in the lower surface of the pushing member 75. The elastic member 98 can deform in a force receiving direction when receiving a force in the thickness direction. Thus, the elastic member 98 absorbs furthermore the uneven thickness of the recording medium 11.

Figure 7:
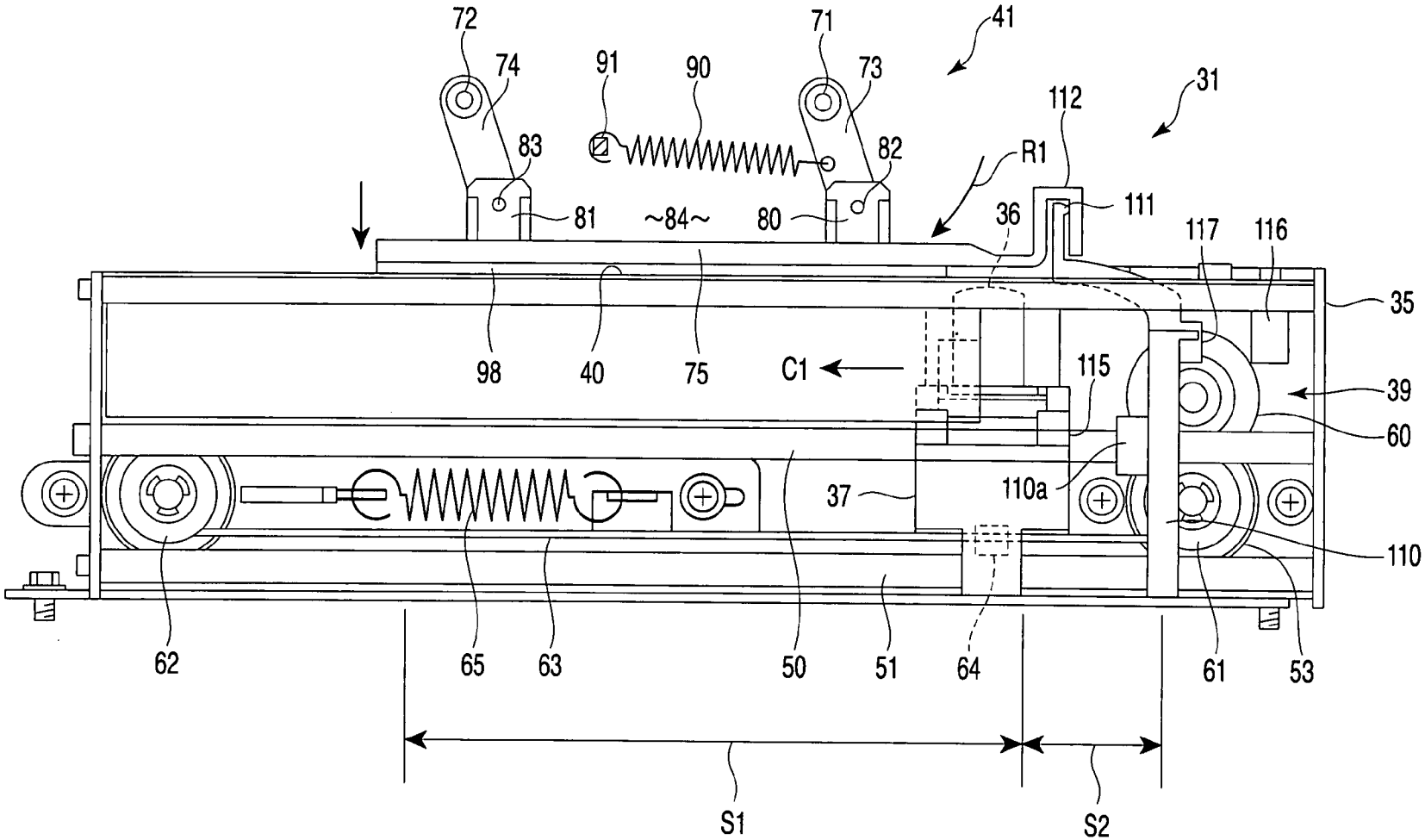
FIG. 7 is a front view of the processing mechanism shown in FIG. 3 with a pushing member moved down.

The carriage 37 can move to the second region S2 farther than the first region S1. As shown in FIG. 3 and FIG. 7, the carriage-driving mechanism 39 of this embodiment has a sliding member 110, which is driven by the carriage 37 while the carriage 37 stays in the second region S2.

The sliding member 110 can fit with the carriage shaft 50 and guide shaft 51, and move in the axial direction of these shafts 50 and 51. At the upper end of the sliding member 110, a engaging piece 111 is formed to interlock the sliding member 110 with the pushing member 75. At one end of the pushing member 75, or at the end close to the sliding member 110, a hook-shaped connector 112 is formed to engage with the engaging piece 111. The engaging piece 111 of the sliding member 110 is movable vertically with respect to the connector 112 of the pushing member 75, but they are fit to move as a single unit in the lateral direction (the directions indicated by the arrows C1 and C2 in FIG. 3).

Since the engaging piece 111 of the sliding member 110 engages with the connector 112 of the pushing member 75 as described above, when the carriage 37 moves from the first region S1 to the second region S2, the pushing member 75 can move in the direction of separating from the medium-holding base 40 (the direction indicated by the arrow R2 in FIG. 3).

A contact piece 115 is provided in a part of the carriage 37, or at the position opposite to the sliding member 110. When the carriage 37 moves to the second region S2, the contact piece 115 contacts the receiver 110*a* of the sliding member 110, thereby the sliding member 110 moves together with the carriage 37 along the carriage shaft 50 in the direction indicated by the arrow C2.

In the frame 35 of the processing mechanism 31, a position sensor 116 is provided to detect that the sliding member 110 is at the standby position (the position indicated in FIG. 3). The position sensor 116 has a function of detecting a detected part 117 of the sliding member 110.

Next, explanation will be given on the operation of the recording medium processing apparatus 10.

When the recording medium 11 is not inserted into the recording medium processing apparatus 10, the carriage 37 stops in the second region S2 shown in FIG. 3. The sliding member 110 is pushed by the carriage 37 toward the standby position at the right end. When the sliding member 110 is at the standby position, the detected part 117 of the sliding member 110 is detected by the position sensor 116.

At the standby position shown in FIG. 3, the connector 112 of the pushing member 75 is moved to the right by the engaging piece 111 of the sliding member 110. Thus, the arm members 73 and 74 are rotated in the arrow R2 direction in FIG. 3, and the pushing member 75 is moved up. In this way, a gap G is formed between the pushing member 75 and medium-holding base 40.

When the recording medium 11 is inserted into the medium insertion slit 22 along the conveying guide 21 of the recording medium processing apparatus 10, the recording medium 11 is conveyed by the conveying mechanism 23 toward the processing unit 24. When the recording medium 11 is conveyed to a predetermined position, a not-shown sensor functions and the conveying mechanism 23 stops. The recording medium 11 is placed on the medium-holding base 40.

After the recording medium 11 stops, the motor 52 of the carriage driving mechanism 39 is rotated in the first direction. When the motor 52 is rotated in the first direction, the carriage 37 is moved in the first direction (the direction indicated by the arrow C1) as shown in FIG. 7. When the carriage 37 is moved in the first direction, the sliding member 110 becomes free. Thus, the arm members 73 and 74 are rotated in the arrow R1 direction by the elastic force of the spring 90 of the holding mechanism 41, and the pushing member 75 moves down toward the medium-holding base 40. Accompanying with the pushing member 75, the sliding member 110 is also moved in the first direction (the direction indicated by the arrow C1). As the detected part 117 of the sliding member 110 is separated from the position sensor 116, it is detected that the sliding member 110 has been moved from the standby position toward the first direction.

As the pushing member 75 moves down toward the medium-holding base 40 as shown in FIG. 7, the recording medium (shown in FIG. 1) is held between the medium-holding base 40 and the pushing member 75. Thus, the warp or bend of the recording medium 11 is corrected and the recording medium 11 is held in a flat position. Besides, the unevenness in the thickness of the recording medium 11 is absorbed by the elastic member 98 provided in the lower surface of the pushing member 75, and the recording medium 11 is prevented from slipping under the pushing member 75.

In the state that the recording medium 11 is held between the medium-holding base and the pushing member 75, the motor 52 is continuously rotated in the first direction, and the carriage 37 is moved further in the first direction (the direction indicated by the arrow C1). While the carriage 37 is moving in the first region S1, the recorded contents of the magnetic recording portion 12 of the recording medium 11 are detected by the head 36. Or, while the carriage 37 is moving in the first direction, data is magnetically recorded in the recording medium 11 by the head 36.

After the carriage moves in the firs direction by a predetermined distance, the motor 52 stops. Therefore, when the motor 52 is rotated in the second direction, the carriage 37 is moved in the second direction (the direction indicated by the arrow C2 in FIG. 3). In this time, the recorded contents of the recording medium 11 may be detected by the head 36.

The carriage 37 moves in the second direction by a predetermined distance, and the carriage 37 moves toward the second region S2 farther than the first region S1. When the carriage 37 goes into the second region S2 and moves further in the second direction, the contact piece 115 of the carriage 37 come in contact with the sliding member 110. Thus, the carriage 37 and sliding member 110 moves in the second direction as a single unit. As the engaging piece 111 of the sliding member 110 moves in the second direction, the pushing member 75 moves in the second direction. Thus, the arm members 73 and 74 are rotated in the direction indicated by the arrow R2, and the pushing member 75 is moved up.

The pushing member 75 is moved up and separated from the recording medium 11, the recording medium 11 is released. In this time, the detected part 117 of the sliding member 110 is detected by the position sensor 116. Based on the output of the position sensor 116, the motor 52 is stopped, and the conveying mechanism 23 is actuated. Thus, the recording medium 11 (show in FIG. 1) is moved along the conveying guide 21 and fed out from the medium insertion slit 22 in the direction indicated by the arrow B.

The recording medium processing apparatus 10 of this embodiment is configured and operated as described hereinbefore. The recording medium processing apparatus 10 pushes the recording medium 11 toward the medium-holding base 40 by the pushing member 75, when reading and/or or recording data from/in the recording medium 11. In the state that the recording medium 11 is pushed by the pushing member 75, data is read and/or recorded by moving the head 36. Thus, according to the recording medium processing apparatus 10 of this embodiment, when data is read from and/or recorded in the recording medium 11, the head 36 is correctly brought into contact with the recording medium 11. In the recording medium processing apparatus 10, the friction force is not changed between the conveying roller and recording medium, and a recording medium is not caught in the conveying path, unlike the conventional apparatus. Therefore, the recording medium processing apparatus 10 of this embodiment provides high accuracy in data reading without changing the recording medium reading speed.

Moreover, the recording medium processing apparatus 10 of this embodiment moves up and down the pushing member 75 of the holding mechanism 41 by using the motor 52 for moving the carriage 37 in the first and second directions. Namely, one motor 52 is shared by the carriage-driving mechanism 39 and holding mechanism 41. This provides the advantages that the configuration of the holding mechanism 41 is simplified, and the number of parts is decreased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A recording medium processing apparatus comprising:

a carriage provided with a head; and a carriage-driving mechanism including a motor for reciprocating the carriage; and wherein the carriage can move to a first region for reading and/or recording information in/from a recording medium, and to a second region farther than the first region;

the recording medium processing apparatus has a medium-holding base to hold the recording medium, and a holding mechanism to press the recording medium to the medium-holding base;

the holding mechanism comprising:

a fixing member located at a position corresponding to the medium-holding base;

an arm member which is held rotatably by the fixing member;

a pushing member which is secured to the arm member and moved from a position close to the medium-holding base to a position separated from the medium-holding base, as the arm member is rotated; and a sliding member which is driven by the carriage while the carriage remains in the second region, and moves the pushing member in a direction of separating from the medium-holding base when the carriage moves to the second region.

2. The recording medium processing apparatus according to claim 1, wherein the holding mechanism has a spring which urges the pushing member toward the medium-holding base, and a connector which transmits the motion of the sliding member to the pushing member.

3. The recording medium processing apparatus according to claim 1, wherein the holding mechanism has a pair of arm members held by the fixing member, and a parallel link is formed by the fixing member, arm members, and pushing member.

4. The recording medium processing apparatus according to claim 3, wherein a movable mechanism which can change the distance from the pushing member to the medium-holding base is further provided in a connecting portion which connects one of the arm members to the pushing member.

5. The recording medium processing apparatus according to claim 1, wherein an elastic member having a rubber elasticity is provided on the surface of the holding member opposite to the medium-holding base.

6. The recording medium processing apparatus according to claim 1, wherein the sliding member has a contact piece which comes in contact with the carriage when the carriage is moved to the second region.

7. The recording medium processing apparatus according to claim 1, further comprising:

a frame which secures the motor is provided; and a carriage shaft which is provided in the frame, and used to guide the carriage and sliding member to the first region and second region.

* * * * *